United States Patent [19]

Clough et al.

[11] Patent Number: 4,858,387

[45] Date of Patent: Aug. 22, 1989

[54] APPARATUS FOR GRINDING A WORKPIECE

[76] Inventors: Arthur H. Clough, Old Coldbrook Rd., Barre, Mass. 01005; Edwin L. Knight, Airport Rd., Ware, Mass. 01082

[21] Appl. No.: 925,715

[22] Filed: Oct. 30, 1986

[51] Int. Cl.[4] ..... B24B 5/04

[52] U.S. Cl. ..... 51/34 E; 51/50 R; 51/105 R

[58] Field of Search ..... 51/34 C, 34 D, 34 E, 51/34 F, 34 G, 48 R, 50 R, 95 R, 95 WH, 166 R, 289 R, 105 R

[56] References Cited

U.S. PATENT DOCUMENTS

| | | | |
|---|---|---|---|
| 1,945,396 | 1/1934 | Gerling | 51/166 |
| 2,076,179 | 4/1937 | Feeney | 51/166 |
| 2,088,402 | 7/1937 | Borck | 51/34 C |
| 2,128,023 | 8/1938 | Specht et al. | 51/35 F X |
| 2,336,145 | 12/1943 | Wild | 51/50 R X |
| 2,441,045 | 5/1948 | Toepfer | 51/34 C X |
| 2,589,191 | 3/1952 | Laase | 51/50 R X |
| 2,710,494 | 6/1955 | Silven | 51/166 |
| 2,774,191 | 12/1956 | Bouchez | 51/34 C |
| 2,981,035 | 4/1961 | Mentley et al. | 51/134.5 |
| 3,247,621 | 4/1966 | Aller | 51/50 |
| 4,417,422 | 11/1983 | Redeker et al. | 51/50 R |

*Primary Examiner*—Robert P. Olszewski

[57] ABSTRACT

A wheel slide 20 for supporting a grinding wheel 40 is mounted on a carraige 100 which extends across a work area to engaged parallel horizontal ways 61, 62 on opposite sides of the axis of rotation B of a workpiece W. The carriage 100 has ways 114, 115, 116 which support the wheel slide 20 for vertical movement toward and away from a horizontal axis B of rotation of the workpiece.

25 Claims, 5 Drawing Sheets

APPARATUS FOR GRINDING A WORKPIECE

This invention relates to an improved apparatus for grinding a workpiece and more specifically to a grinding machine having a carriage which supports a wheel slide for movement toward and away from a workpiece.

Known grinding machines have a base upon which a workpiece is rotatably supported by a headstock and a footstock. A pair of parallel ways adjacent to one side of the base guide movement of a carriage relative to the base. A grinding wheel is rotatably mounted on a wheel slide. The wheel slide is mounted on the carriage and is movable toward and away from the axis of rotation of the workpiece. The grinding wheel is supported on the wheel slide for rotation about an axis which extends parallel to the axis of rotation of the workpiece. One example of such an apparatus for grinding a workpiece may be found in U.S. Pat. No. 2,710,494 entitled Grinding Machine and issued June 14, 1955.

During operation of an apparatus having this construction, operating forces must be transmitted from the grinding wheel through the carriage to a pair of ways which are both offset to one side of the workpiece. The offset location of the ways is detrimental to the stability of the carriage since all of the operating forces are transmitted to one side of the work area.

The invention is a grinding machine characterized by a carriage which extends across the work area to engage ways on opposite sides of the axis of rotation of the workpiece. When the carriage extends vertically, operating forces which originate in the work area are transmitted from the carriage to the ways in a balanced manner. This increases the stability of the carriage to provide solid support for the grinding wheel and thereby promote grinding accuracy.

DETAILED DESCRIPTION OF THE INVENTION

Figure 1:
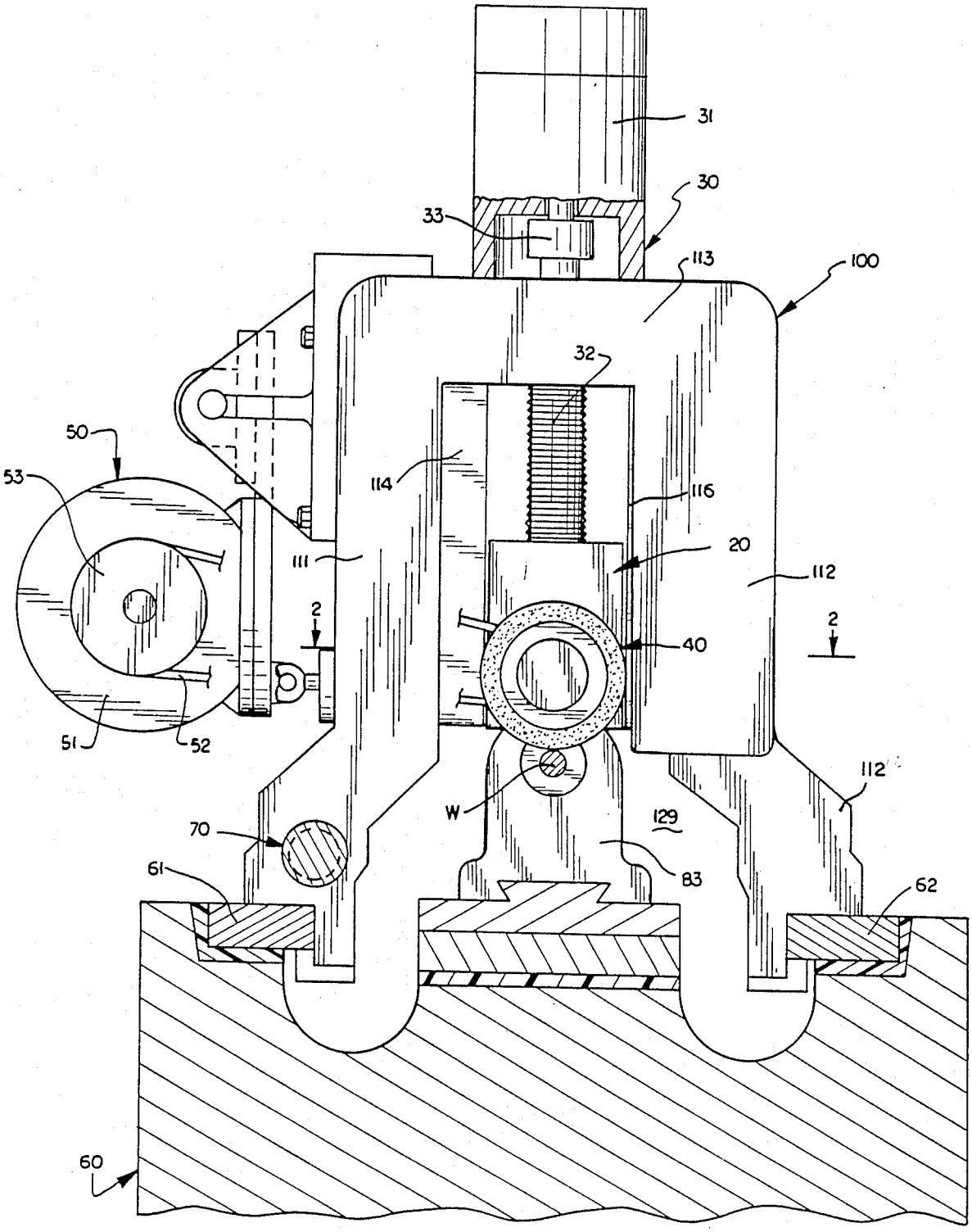
FIG. 1 is fragmentary elevational view illustrating the relationship between a carriage and a pair of ways disposed on opposite sides of a workpiece.

Referring now to the drawings, FIG. 1 illustrates a grinding apparatus having an upright carriage 100 which supports a wheel slide 20 for vertical movement toward and away from a workpiece W by a wheel slide drive assembly 30. A grinding wheel 40 is supported on the wheel slide 20 for rotation about a horizontal axis by a grinding wheel drive assembly 50. The carriage 100 is movable relative to a base 60 of the grinding apparatus by a carriage drive assembly 70.

The carriage 100 has a pair of vertical legs 111 and 112 which are interconnected by a horizontal connector section 113. The legs 111 and 112 and connector section 113 result in the carriage having an upside-down U-shaped cross sectional configuration in a vertical plane extending perpendicular to a horizontal axis of rotation of the workpiece W. The legs 111 and 112 flare outwardly at their lower end portions to increase the stability of the carriage 100.

The carriage 100 is supported on horizontal ways 61 and 62 which are disposed on opposite sides of the axis of rotation of the workpiece W and extend parallel to the axis of rotation of the workpiece. The ways 61 and 62 are each disposed the same distance from the vertical plane containing the axes of rotation of the workpiece W and grinding wheel 40. Since the carriage 100 spans the work area where operating forces are generated by engagement of the grinding wheel 40 with the workpiece W, operating forces are transmitted in a balanced manner by the vertical carriage legs 111 and 112 to the ways 61 and 62.

The wheel slide 20 is movable along a vertical path extending perpendicular to the axis of rotation of the workpiece W by operation of the drive assembly 30. The wheel slide drive assembly 30 includes a motor 31 mounted on the connector section 113 of the carriage 100. The motor 31 is connected with a vertical drive screw 32 through a coupling 33. The drive screw 32 is in turn connected with the wheel slide 20. The axis of rotation of the drive screw 32 extends perpendicular to the axis of rotation of the workpiece W and is disposed in a vertical plane containing the axis of rotation of the workpiece W and the axis of rotation of the grinding wheel 40.

The grinding wheel drive assembly 50 includes a motor 51 which is mounted on the leg 111 of the carriage 100. The grinding wheel drive motor 51 is connected with the grinding wheel 40 by a belt 52 which extends around a sheave 53 connected with the motor 51.

The vertical carriage 100 facilitates loading and/or unloading of a workpiece W from either side of the grinding apparatus. However, if desired, the orientation of the carriage 100 could be changed. For example, the carriage could have a horizontal orientation rather than the illustrated vertical orientation. If this was done, one of the ways 61 or 62 would be located above the axis of rotation of the workpiece while the other way would be located below the axis of rotation of the workpiece.

Figure 2:
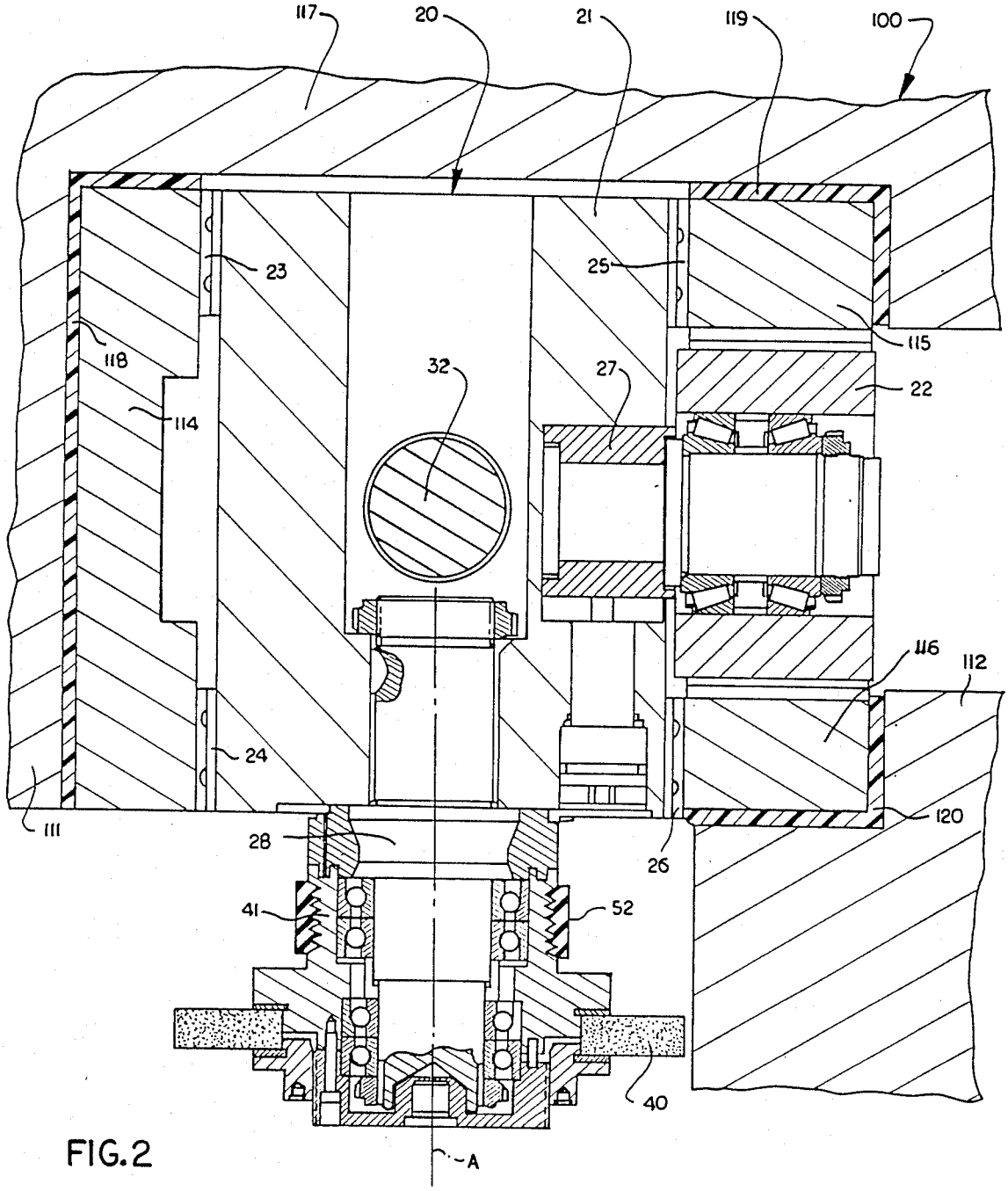
FIG. 2 is an enlarged fragmentary sectional view, taken generally along the line 2—2 of FIG. 1, illustrating the relationship between a wheel slide and the carriage.

FIG. 2 illustrates the relationship between the wheel slide 20 and vertical ways 114, 115 and 116 disposed within the carriage 100. The vertical way 114 is fixedly connected with the leg 111 of the carriage. The vertical ways 115 and 116 are fixedly connected with the leg 112 of the carriage. The ways 115 and 116 are disposed on the opposite side of the grinding wheel axis A from the way 114. The two legs 111 and 112 of the carriage are interconnected by a backwall 117 which extends between the legs.

The vertical ways 114, 115 and 116 are connected with the legs 111 and 112 and backwall 117 of the carriage 100 by bodies 118, 119 and 120 of cast-in-situ material. Although the bodies 118, 119 and 120 could be formed of many different known materials, it is preferred to use "Sikadur 42" (trademark) structural adhesive which is commercially available from Sika Corporation and is an epoxy resin with sand and/or quartz aggregate fillers. The ways 114, 115 and 116 are rigidly supported by the legs 111 and 112 and backwall 117 of the carriage 100 to provide a stable mounting for the wheel slide 20. Although the ways 114, 115 and 116 are vertical in the illustrated embodiment of the invention, the ways could be horizontal if desired.

The wheel slide 20 includes a rectangular main section 21 and a rectangular guide section 22 which is pivotally connected to the main section 21. A plurality of hydrostatic bearings 23, 24, 25 and 26 engage the ways 114, 115 and 116 to guide movement of the rectangular main section 21 of the wheel slide relative to the ways. An adjustment assembly 27 is connected with the main section 21 and guide section 22 of the wheel slide 20 to adjust the orientation of an axis A about which the grinding wheel 40 rotates relative to the horizontal axis of rotation of the workpiece.

The grinding wheel 40 is rotatably supported on an arbor 28 which is fixedly connected to the main section 21 of the wheel slide 20. A sheave 41 is connected with the grinding wheel 40 and is engaged by the belt 52 to rotate the grinding wheel 40 about its central axis A. The grinding wheel 40 has an outside diameter of six to nine inches. The workpiece W has a maximum diameter of six inches.

Figure 3:
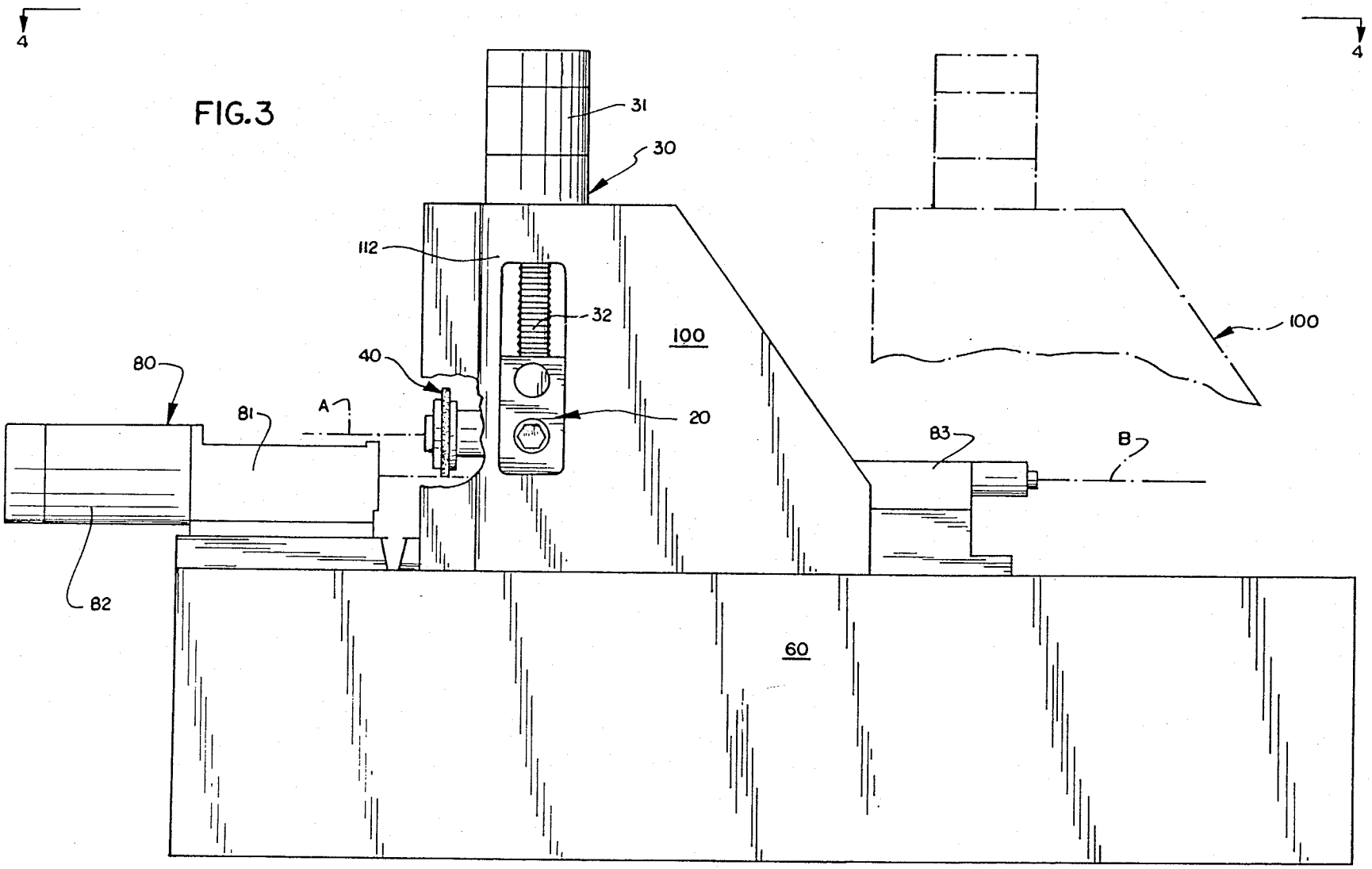
FIG. 3 is a side elevational view of a grinding apparatus having the carriage of FIG. 1.

FIG. 3 illustrates the relationship of a workpiece support and drive assembly 80 to the carriage 100 and base 60. The workpiece support and drive assembly 80 includes a headstock 81 having a spindle which engages one end of the workpiece and is rotated by a drive motor 82. The opposite end of the workpiece is supported by a footstock 83.

The headstock 81 and footstock 83 support the workpiece for rotation about a horizontal axis B. The axis of rotation B of the workpiece is disposed directly beneath the axis of rotation A of the grinding wheel. The axes of rotation A and B of the grinding wheel 40 and workpiece are disposed in a vertical plane which extends parallel to the path of movement of the carriage 100.

The carriage 100 is movable along the base 60 between a forward position disposed at the left (as viewed in FIG. 3) end portion of the base and a rearward position disposed at the right (as viewed in FIG. 3) end portion of the base. When the carriage 100 is in the forward position, a portion of the headstock 81 is enclosed by the carriage. Similarly, when the carriage 100 is in the rearward position, shown in dashed lines in FIG. 3, the footstock 83 is enclosed by the carriage. To accomodate the headstock 81 and the footstock 83, the carriage 100 has a central opening 129 (FIG. 1) which extends through the carriage.

Figure 4:
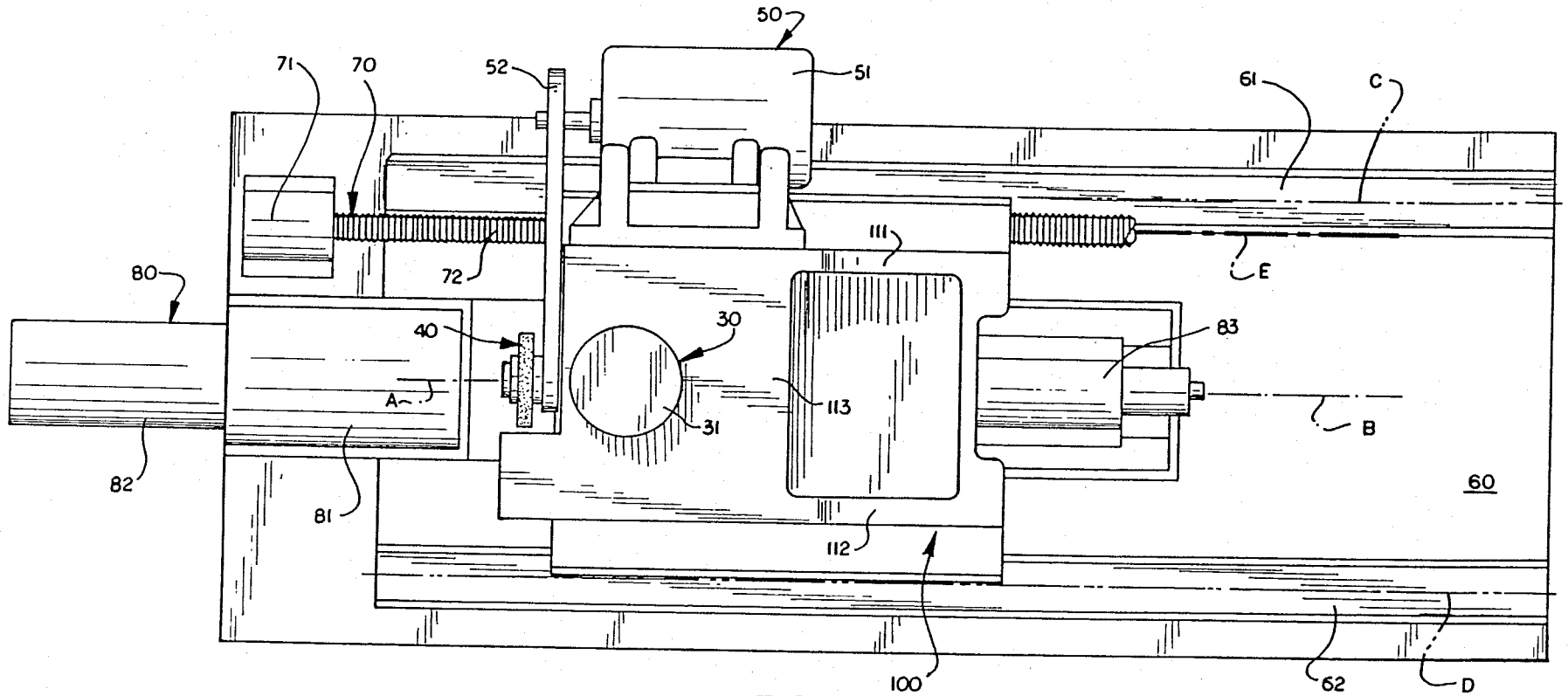
FIG. 4 is a plan view, taken generally along the line 4—4 of FIG. 3, further illustrating the construction of the grinding apparatus.

FIG. 4 illustrates the manner in which the ways 61 and 62 extend along the base 60. The ways 61 and 62 have parallel central axes C and D which extend parallel to the axis A of rotation of the grinding wheel 40 and the axis B of rotation of the workpiece. The horizontal way axes C and D are spaced equal distances from and are disposed on opposite sides of a vertical plane containing the axis of A of rotation of the grinding wheel 40 and the axis B of rotation of the workpiece. The axes C and D are disposed at the same level, that is in a single horizontal plane.

The carriage 100 is movable along the ways 61 and 62 between the forward position in which the grinding wheel 40 is adjacent to the headstock 81 and the rearward position in which the grinding wheel is adjacent to the footstock 83. The central opening 129 (FIG. 1) in the carriage 100 is large enough to enable the carriage to clear the headstock 81 and footstock 83 during movement of the carriage along the ways 61 and 62 with the grinding wheel 40 in a raised position. When the carriage 100 is in the forward position, a portion of the headstock 81 is disposed in the opening 129 midway between the carriage legs 111 and 112. When the carriage 100 is in the rearward position, the footstock 83 is disposed in the opening 129 midway between the legs 111 and 112.

The carriage drive 70 includes a motor 71 mounted on the base 60 and a drive screw 72 which is connected with the carriage 100 and the motor 71. The drive screw has a central axis E which extends parallel to the way axes C and D. The drive screw 72 is coextensive with the ways 61 and 62. Therefore, operation of the motor 71 rotates the drive screw 72 to move the carriage 100 along the ways 61 and 62.

A grinding wheel drive assembly 50 moves with the carriage 100 along the ways 61 and 62. Thus, the motor 51 is pivotally mounted on the carriage 100 and is connected with the grinding wheel 40 by the drive belt 52.

Figure 5:
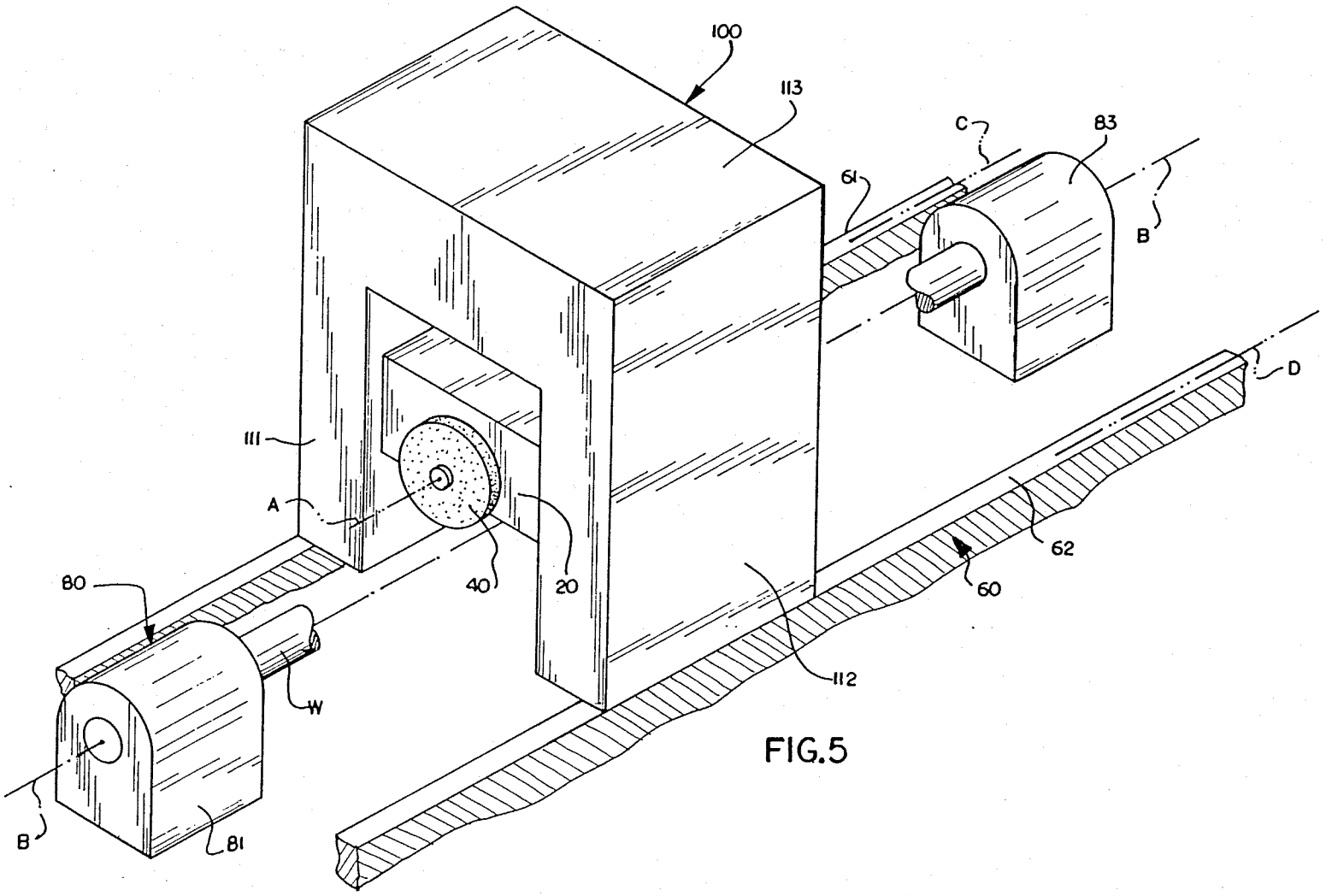
FIG. 5 is a schematic illustration of the grinding apparatus.

FIG. 5 is a schematic illustration depicting the relationship between the axis B of rotation of the workpiece W, the axis A of rotation of the grinding wheel 40 and the axes C and D of the ways 61 and 62. The way axes C and D are disposed in a horizontal plane on opposite sides of and equal distances from a vertical plane containing the axis B of rotation of the workpiece W and the axis A of rotation of the grinding wheel 40. The carriage 100 spans or extends across the work area to engage the parallel ways 61 and 62 on opposite sides of the axis B of rotation of the workpiece W. This results in a balanced transmission of operating forces from the carriage 100 to the ways 61 and 62 to enhance the stability of the carriage 100. The relatively stable carriage 100 provides a solid support for the wheel slide 20 to thereby to promote increased grinding accuracy.

OPERATION

When a workpiece W is to be ground, the wheel slide 20 is first raised to a position adjacent to the connector section 113 of the carriage 100. The workpiece W is then mounted on the headstock 81 and footstock 83 with the axis B of the workpiece extending parallel to the axis A of the grinding wheel. The carriage drive assembly 70 is then operated to move the carriage along the ways 61 and 62 to a location in which the grinding wheel 40 is disposed directly above a portion of the workpiece W to be ground. The wheel slide drive assembly 30 is then operated to lower the wheel slide 20 and move the grinding wheel 40 into engagement with the workpiece. As this is occurring, the grinding wheel 40 is being rotated about the axis A by the grinding wheel drive assembly 50 and the workpiece W is being rotated about the axis B by operation of the headstock drive motor 82.

Operating forces generated during the grinding of the workpiece W are transmitted from the grinding wheel 40 to the wheel slide 20. These operating forces are then transmitted to the center of the connector section 113 of the carriage 100 by the drive screw 32. Substantially equal vertical operating forces are transmitted from the connector section 113 to the ways 61 and 62 by the vertical legs 111 and 112 of the carriage 100. Since the operating forces are transmitted to the ways 61 and 62 on opposite sides of the axis B of rotation of the workpiece W, there is a balanced application of forces to the carriage 100. This enhances the stability of the carriage 100 so that the wheel slide 20 can be accurately moved by the drive assembly 30 to position and support the grinding wheel 40 at a desired location relative to the workpiece W during grinding of the workpiece.

Having described the invention, what is claimed is:

1. An apparatus for use in grinding a workpiece (W), said apparatus comprising a base (60), means (80) for supporting the workpiece (W) for rotation relative to said base (60), first and second spaced apart ways (61, 62) on said base (60) and extending parallel to and disposed on opposite sides of the axis (B) of rotation of the workpiece (W), a carriage (100) movable along said first and second ways (61, 62), said carriage having a first leg (111) extending perpendicular to and movable along said first way (61), a second leg (112) extending perpendicular to and movable along said second way (62) and a connector section (113) extending between said first and second legs, a wheel slide (20) mounted on said carriage (100) and movable relative to said carriage along a path disposed between and extending parallel to said first and second legs (111, 112), a rotatable grinding wheel (40) mounted on said wheel slide (20), wheel slide drive means (30) connected with said connector section (113) of said carriage (100) and said wheel slide (20) for moving said wheel slide (20) and grinding wheel (40) relative to said carriage and toward and away from the axis (B) of rotation of the workpiece along the path between said first and second legs (111, 112), and grinding wheel drive means (50) for rotating said grinding wheel (40), said apparatus being characterized by said grinding wheel drive means (50) including a motor (51) mounted on said carriage (100) at a location offset to one side of the path of movement of said wheel slide (20) to thereby tend to minimize the mass which is moved by said wheel slide drive means.

2. An apparatus as set forth in claim 1 wherein said carriage (100) extends across the space between said ways (61, 62) and through a plane containing the axes of rotation (A, B) of the workpiece (W) and the grinding wheel (40).

3. An apparatus as set forth in claim 1 wherein said means for supporting the workpiece for rotation relative to the base includes a headstock (81) and a footstock (83) disposed between said ways (61, 62).

4. An apparatus as set forth in claim 1 wherein said means (80) for supporting the workpiece for rotation relative to said base (60) includes a headstock (81) and a footstock (83) for supporting the workpiece for rotation about a horizontal axis (B) disposed in a vertical plane which is located between said ways (61, 62), said ways having horizontal axes (C, D) which extend parallel to the axis of rotation of the workpiece.

5. An apparatus as set forth in claim 1 wherein said ways (61, 62) have parallel central axes (C, D) which are disposed in a first plane extending through said ways, said means (80) for supporting the workpiece for rotation include means (81, 83) for supporting the workpiece with its central axis (B) in a second plane which extends perpendicular to the first plane and intersects the first plane at a location between said ways.

6. An apparatus as set forth in claim 1 further including carriage drive means (70) connected with said base (60) and one of the legs (111) of said carriage (100) for moving said carriage along said ways (61, 62).

7. An apparatus as set forth in claim 1 wherein said legs (111, 112) of said carriage (100) extend upwardly from said ways (61, 62) and said connector section (113) is disposed above said ways.

8. An apparatus as set forth in claim 1 wherein said means for supporting the workpiece (80) includes first support means (81) for rotatably supporting a first end portion of the workpiece and second support means (83) for rotatably supporting a second end portion of the workpiece, said apparatus further including carriage drive means (70) for moving said carriage along said ways (61, 62) between a first position in which the grinding wheel (40) is adjacent to the first end portion of the workpiece and a second position in which the grinding wheel is adjacent to the second end portion of the workpiece, said first leg (111) being disposed on a first side of said second support means (83) and said second leg (112) being disposed on a second side of said second support means when said carriage is in said second position.

9. An apparatus as set forth in claim 1 wherein said motor (51) is mounted on a side of said first leg (111) opposite from said wheel slide (20), said grinding wheel drive means (50) including means (52) for transmitting torque from said motor (51) to said grinding wheel (40).

10. An apparatus as set forth in claim 1 wherein said carriage includes a third way (114) on said first leg (111) of said carriage (100) for engaging a first side of said wheel slide (20) and a fourth way (116) on said second leg (112) of said carriage (100) for engaging a second side of said wheel slide (20), said third and fourth ways (114, 116) being disposed on opposite sides of the path of movement of said wheel slide (20).

11. An apparatus as set forth in claim 1 wherein said wheel slide (20) is movable along a vertical path disposed between said first and second legs of said carriage.

12. An apparatus as set forth in claim 11 wherein said wheel slide drive means includes a drive screw (32) connected with said carriage (100) and said wheel slide (20) and motor means for rotating said drive screw about an axis extending between said legs (111, 112) of said carriage (100) to move said wheel slide relative to said carriage.

13. An apparatus for use in grinding a workpiece (W), said apparatus comprising a base (60), means (80) for supporting a workpiece (W) for rotation relative to said base about a horizontal axis (B), said means (80) for supporting the workpiece including headstock means (81) for rotatably supporting a first end portion of the workpiece and footstock means (83) for rotatably supporting a second end portion of the workpiece, first and second spaced apart ways (61, 62) on said base (60) and extending parallel to and disposed on opposite sides of the horizontal axis of rotation (B) of the workpiece (W), said first and second ways (61, 62) being disposed beneath a horizontal plane containing the axis of rotation (B) of the workpiece (W), a carriage (100) movable along said first and second ways (61, 62), said carriage (100) having a generally upside-down U-shaped cross sectional configuration with a first leg (111) extending upwardly from said first way (61), a second leg (112) extending upwardly from said second way (62), and a connector section (113) extending between said first and second legs, carriage drive means (70) connected to one of said first and second legs (111, 112) for moving said carriage (100) along said first and second ways (61, 62), a wheel slide (20) disposed between said first and second legs (111, 112) and movable relative to said carriage (100) along a vertical path disposed between said legs, said carriage including a third way (114) on said first leg (111) and engaging a first side of said wheel slide (20) for guiding movement of said wheel slide relative to said carriage (100) along the vertical path and a fourth way (116) on said second leg (112) and engaging a second side of said wheel slide for guiding movement of said wheel slide relative to said carriage (100) along the vertical path, a rotatable grinding wheel (40) mounted on said wheel slide (20) for movement therewith relative to said carriage (100), wheel slide drive means (30) for moving said wheel slide (20) and grinding wheel (40) relative to said carriage (100) in directions toward and away from the axis of rotation of the workpiece, said wheel slide drive means including a drive screw (32) connected with said wheel slide (20) and a wheel slide drive motor (31) mounted on said connector section (113) and connected with said drive screw (32), and grinding wheel drive means (50) mounted on said carriage for rotating said grinding wheel (40), said grinding wheel drive means including a grinding wheel drive motor (51) mounted on said carriage (100) and means (52) for transmitting torque from said grinding wheel drive motor (51) to said grinding wheel (40) to thereby tend to minimize the mass which is moved by said wheel slide drive means.

14. An apparatus as set forth in claim 13 wherein said grinding wheel drive motor (51) is mounted on said carriage (100) at a location offset to one side of the path of movement of said wheel slide (20).

15. Apparatus for use in grinding a workpiece (W), of the type including a base (60), means (80) for supporting a workpiece (W) for rotation relative to said base about a horizontal axis (B) including headstock means (81) for rotatably supporting a first end portion of the workpiece and footstock means (83) for rotatably supporting a second end portion of the workpiece, first and second spaced apart ways (61, 62) on said base (60) and extending parallel to and disposed on opposite sides of the horizontal axis of rotation (B) of the workpiece (W), said first and second ways (61, 62) being disposed beneath a horizontal plane containing the axis of rotation (B) of the workpiece (W), a carriage (100) movable along said first and second ways (61, 62), a wheel slide (20) mounted for vertical movement on said carriage (100), a rotatable grinding wheel (40) mounted for rotation about a horizontal axis parallel but above said axis of rotation of said workpiece, and means for rotating said grinding wheel (40) wherein said carriage (100) is characterized by being formed as a rigid housing located above and spanning the horizontal axis (B) of rotation of said workpiece (W), said housing formed by a pair of generally vertically extending side walls (111, 112), a connector section top wall (113) integrally connecting the upper ends of said side walls (111, 112), and an end wall (113) integrally connecting together one end of each side wall (111, 112) to form an inverted enclosure at least partially open at one end, lower portions of said side walls (111, 112) extending below said end wall (113) to form a pair of leg portions straddling said horizontal axis (B) of rotation of said workpiece (W), said leg portions being flared outwardly from said side walls (111, 112) to increase the stability of said carriage (100).

16. The apparatus according to claim 15 further characterized by said wheel slide (20) being disposed between said first and second side walls (111, 112) for movement along a vertical path there between.

17. The apparatus according to claim 15 further characterized by said grinding wheel (40) being mounted on said wheel slide (20) to extend towards said open end of said housing forming said carriage (100).

18. The apparatus according to claim 15 further characterized by said carriage (100) being integrally formed of a heavy walled casting.

19. The apparatus according to claim 15 further characterized by means (114, 116) mounting said wheel slide (20) for vertical linear movement between and on said side walls (111, 112).

20. An apparatus as set forth in claim 15 wherein said means for rotating said grinding wheel (40) including a motor (51) mounted on said carriage (100) at a location offset to one side of the path of movement of said wheel slide (20).

21. Apparatus for use in grinding a workpiece (W), of the type including a base (60), means (80) for supporting a workpiece (W) for rotation relative to said base about a horizontal axis (B) including headstock means (81) for rotatably supporting a first end portion of the workpiece and footstock means (83) for rotatably supporting a second end portion of the workpiece, first and second spaced apart ways (61, 62) on said base (60) and extending parallel to and disposed on opposite sides of the horizontal axis of rotation (B) of the workpiece (W), said first and second ways (61, 62) being disposed beneath a horizontal plane containing the axis of rotation (B) of the workpiece (W), a carriage (100) movable along said first and second ways (61, 62), a wheel slide (20) mounted for vertical movement on said carriage (100), a rotatable grinding wheel (40) mounted for rotation about a horizontal axis parallel but above said axis of rotation of said workpiece, and means for rotating said grinding wheel (40), said means for rotating said grinding wheel (40) includes a motor (51) mounted on said carriage (100) at a location offset to one side of the path of movement of said wheel slide (20) to thereby tend to minimize the mass which is moved with said wheel slide, said carriage (100) being formed as a rigid housing located above and spanning the horizontal axis (B) of rotation of said workpiece (W), said housing formed by a pair of generally vertically extending side walls (111, 112), a connector section top wall (113) integrally connecting the upper ends of said side walls (111, 112), and an end wall (113) integrally connecting together one end of each side wall (111, 112) to form an inverted enclosure at least partially open at one end, lower portions of said side walls (111, 112) extending below said end wall (113) to form a pair of leg portions straddling said horizontal axis (B) of rotation of said workpiece (W).

22. The apparatus according to claim 21 further characterized by said wheel slide (20) being disposed between said first and second side walls (111, 112) for movement along a vertical path there between.

23. The apparatus according to claim 21 further characterized by said grinding wheel (40) being mounted on said wheel slide (20) to extend towards said open end of said housing forming said carriage (100).

24. The apparatus according to claim 21 further characterized by said carriage (100) being integrally formed of a heavy walled casting.

25. The apparatus according to claim 21 further characterized by means (114, 116) mounting said wheel slide (20) for vertical linear movement between and on said side walls (111, 112).

* * * * *